US008910550B2

(12) United States Patent
Furuta

(10) Patent No.: US 8,910,550 B2
(45) Date of Patent: Dec. 16, 2014

(54) PRINTER

(75) Inventor: Takashi Furuta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 336 days.

(21) Appl. No.: 13/170,062

(22) Filed: Jun. 27, 2011

(65) Prior Publication Data

US 2011/0314981 A1 Dec. 29, 2011

(30) Foreign Application Priority Data

Jun. 29, 2010 (JP) ..... 2010-147453

(51) Int. Cl.

| | |
|---|---|
| ***B26D 7/00*** | (2006.01) |
| ***B26D 7/18*** | (2006.01) |
| ***B41J 11/00*** | (2006.01) |
| ***B41J 11/70*** | (2006.01) |

(52) U.S. Cl.

CPC ..... *B41J 11/70* (2013.01); *B41J 11/0065* (2013.01)

USPC ..... 83/81; 83/149; 83/167

(58) Field of Classification Search

USPC ..... 83/81, 167, 108, 149, 150, 102, 103, 83/104, 105, 109, 694, 923, 145; 414/934

See application file for complete search history.

(56) References Cited

U.S. PATENT DOCUMENTS

| | | | | |
|---|---|---|---|---|
| 3,984,094 | A * | 10/1976 | Stocker | 271/303 |
| 4,445,409 | A | 5/1984 | Mohr | |
| 4,466,319 | A * | 8/1984 | Cogswell et al. | 83/116 |
| 5,438,435 | A * | 8/1995 | Lawniczak | 358/496 |
| 5,459,493 | A * | 10/1995 | Johnson | 346/136 |
| 6,474,885 | B2 * | 11/2002 | Kuzniarek et al. | 400/624 |
| 7,395,744 | B2 * | 7/2008 | Connor | 83/106 |
| 7,461,578 | B2 * | 12/2008 | Tamura et al. | 83/147 |
| 7,922,056 | B2 * | 4/2011 | Kishi et al. | 227/79 |
| 7,987,751 | B2 * | 8/2011 | Shiokawa et al. | 83/147 |
| 8,177,213 | B2 * | 5/2012 | Hirabayashi | 270/58.07 |
| 8,272,797 | B2 * | 9/2012 | Morimoto et al. | 400/621 |
| 2005/0262986 | A1 | 12/2005 | Connor | |
| 2006/0266180 | A1 * | 11/2006 | Alon et al. | 83/167 |
| 2007/0295178 | A1 * | 12/2007 | Tsuji et al. | 83/167 |
| 2008/0236353 | A1 * | 10/2008 | Kent et al. | 83/167 |
| 2009/0183611 | A1 * | 7/2009 | Khubani | 83/13 |
| 2010/0180778 | A1 * | 7/2010 | Walker et al. | 99/537 |

FOREIGN PATENT DOCUMENTS

| | | | |
|---|---|---|---|
| CN | 101480882 | A | 7/2009 |
| CN | 101544135 | A | 9/2009 |
| JP | 11-254771 | A | 9/1999 |
| JP | 2001-063166 | A | 3/2001 |
| JP | 2001-105677 | A | 4/2001 |
| JP | 2004-160855 | A | 6/2004 |
| JP | 2010-137506 | A | 6/2010 |

* cited by examiner

*Primary Examiner* — Omar Flores Sanchez

(74) *Attorney, Agent, or Firm* — Canon USA Inc IP Division

(57) ABSTRACT

A printer according to the present invention includes a recording unit that makes recording on recording paper, a cutter unit that has a movable cutter edge to cut the recording paper, and a containing portion that receives recorded matter, which is the recorded paper cut by the cutter unit. Further, the printer includes a cut piece collecting portion that collects cut pieces, which are recording paper cut by the cutter unit, and a cut piece collecting portion cover that opens/closes in conjunction with a cutting operation of the cutter unit. The recording paper cut by the cutter unit is collected by a cut piece collecting portion if the cut piece collecting portion cover is in an open state and is made movable to the containing portion if the cut piece collecting portion cover is in a closed state. Further, the cut piece collecting portion cover performs one opening/closing operation for a predetermined number of cutting operations.

17 Claims, 14 Drawing Sheets

PRINTER

BACKGROUND OF THE INVENTION

1. Field of the Invention

The present invention relates to a printer that makes a record on recording paper, and in particular, relates to a printer having a function to cut recording paper.

2. Description of the Related Art

As a kind of printer among printers, copiers, and facsimiles, a thermal printer is known and used in ordinary households as a printer to record image data acquired by a digital camera or the like on recording paper. Thermal printers discharge recording paper at various positions and some printers discharge recording paper to the front side of the printer, or in an upward direction, or even in a direction to the back side. Recently, demand for printers requiring only a smaller installation area that can be installed saving a space, has been growing and the upward discharge system which is superior in this respect is gaining attention.

Some thermal printers use continuous paper such as a roll paper as the recording paper and cuts off a recording completed portion of the continuous paper by a cutter contained in the printer without any margin around the cut recorded matter so that the so-called borderless record can be made.

As a method of making borderless recording, a method of cutting recorded paper to a specified size by using a cutter provided inside a printer after a cutting position of the recorded paper is adjusted by a roller for discharge is known. However, it is difficult to eliminate cutting position shifts when cutting is carried out between a recorded portion and an unrecorded portion of recording paper. Thus, instead of cutting a boundary position between a recorded portion and an unrecorded portion, a method of cutting recording paper before the boundary position between a recorded portion and an unrecorded portion reaches the cutter position is used. According to this method, a small recorded portion remains on the side of the recording paper yet to be recorded (on the side of unrecorded portions) after the recorded matter as cut paper is clipped and the product is cut off as cut paper. Thus, the recording paper is conveyed again so that the boundary between a recorded portion and an unrecorded portion is positioned downstream from the cutter position in consideration of shift of a cutting position. Accordingly, the recording paper is cut while the remaining recorded portion and a small unrecorded portion exist downstream from the cutter position. In this manner, the cut recorded matter can be prevented from containing an unrecorded portion and also the remaining roll paper after the cutting can be prevented from containing a recorded portion. In this case, the cut portion containing the remaining recorded portion and a small unrecorded portion (for the sake of convenience, referred to herein as a "margin portion") becomes cut pieces and needs to be collected.

As an example of conventional technology, a method of providing a movable guide member downstream from the cutting position of the cutter and providing a cut piece collecting portion downward in the vertical direction on the flank downstream from the cutter position is known. Japanese Patent Application Laid-Open No. 2004-160855 discusses the downward discharge and horizontal discharge. First, when a recorded portion of the recording paper is cut, the guide member constitutes a part of a conveyance route of recording paper and next, when the remaining recorded portion and an unrecorded portion (margin portion) of the recording paper are cut, the guide member moves to break the conveyance route of the recording paper. In this manner, margin portions which are cut, that is, the cut pieces, get out of the conveyance route of recording paper and fall freely to be collected by the cut piece collecting portion provided in the vertical direction on the flank downstream from the cutter position.

However, the cut piece collecting portion is not sealed according to the above conventional technology and thus, if the printer is tilted when the user carries the printer, cut pieces may be scattered about, causing a recording failure or discharge failure. Moreover, the upward discharge may be desired to improve design or to save the installation area. If an attempt is made to apply the above conventional technology applied to the horizontal discharge or downward discharge, also applicable to the upward discharge, cut pieces will be scattered about inside the printer because cut pieces return to the conveyance route on the upstream side from the cutter position, instead of the downstream side when cut pieces fall freely. Scattering of such cut pieces may prevent subsequent recording or conveyance.

SUMMARY OF THE INVENTION

The present invention is directed to a printer of the upward discharge type that collects cut pieces without scattering cut pieces and prevents cut pieces once collected from being scattered.

According to an aspect of the present invention, a printer includes a printing unit that prints an image on recording paper, a cutter unit having a movable cutter configured to cut the recording paper, wherein a portion of the recording paper on which the image is printed is cut as a printed portion and the portion of the recording paper adjacent to the printed portion is cut as a cut piece, a containing portion that receives the printed portion cut by the cutter unit, a cut piece collecting portion that collects the cut piece cut by the cutter unit, and a cut piece collecting portion cover that can be opened/closed and is opened/closed in conjunction with a cutting operation of the cutter unit, wherein when the cut piece collecting portion cover is in an open state, the recording paper cut by the cutter unit is collected by the cut piece collecting portion, when the cut piece collecting portion cover is in a closed state, the recording paper cut by the cutter unit can move to the containing portion of the recording paper since an entry to the cut piece collecting portion is restricted by the cut piece collecting portion cover, and the cut piece collecting portion cover performs one opening/closing operation for a predetermined number of cutting operations by the cutter unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
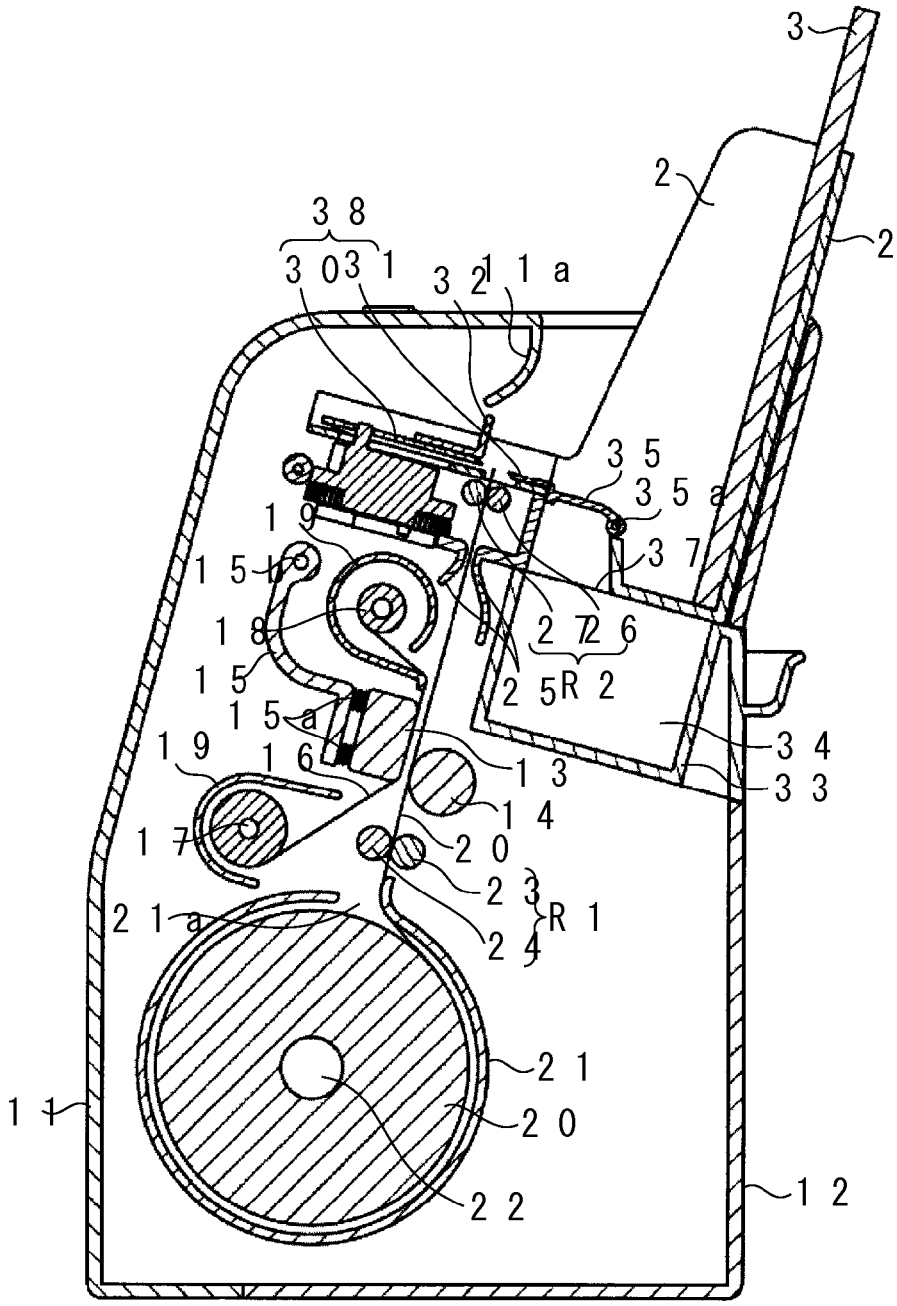
FIG. 1 is a schematic view of a cross section of an exemplary embodiment of a printer according to the present invention.

Various exemplary embodiments, features, and aspects of the invention will be described in detail below with reference to the drawings.

Exemplary embodiments of the present invention will be described below based on appended drawings. The same reference numerals are attached to structural elements having the same function in drawings and a description thereof may be not described.

FIG. 1 is a schematic view of a cross section of an exemplary embodiment of a printer according to the present invention. The driving and operation of each unit of a printer in the present exemplary embodiment are controlled by a central processing unit (CPU) (not illustrated) and the CPU reads a program from a memory (not illustrated) and controls the driving and operation of each unit or performs arithmetic processing based on the read program.

An internal structure of a printer according to the present invention is protected by a front cover 11 and a rear cover 12. In the printer, a roll paper 20 is pulled out of a paper cassette 21 on which an image is recorded by a thermal head 13. Then, the roll paper 20 is cut to obtain a recorded matter as cut paper of a desired size. The recorded matter obtained in this manner is contained in a containing portion 2 positioned above.

More specifically, the roll paper 20 in a continuous belt shape, which is recording paper, is wound around a bobbin 22 and maintained inside the paper cassette 21. The paper cassette 21 has a slit 21*a* provided in a portion of an outer circumferential surface thereof so that the roll paper 20 can be discharged from inside the paper cassette 21. When paper is fed, the bobbin 22 is rotated and the tip of the roll paper 20 is sent out of the paper cassette 21 via the slit 21*a*.

In the present exemplary embodiment, the route on which recording paper passes through a recording unit described below from inside the paper cassette 21, a recorded portion of the recording paper is cut by a cutter unit described below, and cut and separated recorded matter reaches the containing portion 2, is referred to as a "conveyance route of recording paper".

A roller pair R1 of a capstan roller 23 and a pinch roller 24 is positioned opposite to the capstan roller 23 across the conveyance route of the roll paper 20. The roller pair R1 is provided downstream of the paper cassette 21 when viewed in the conveyance direction of the roll paper 20. The roll paper 20 sent out from the paper cassette 21 is sandwiched between the roller pair R1 and conveyed by the capstan roller 23 being rotated clockwise in the figure.

The recording unit is provided downstream from the roller pair R1. In the recording unit, the thermal head 13 and a platen roller 14 positioned opposite to the thermal head 13 across the conveyance route of the roll paper 20 are provided. The thermal head 13 is substantially integrated with a head arm 15 including a rotation center 15*b* and a coil spring 15*a* made of an elastic member. The thermal head 13 is movable toward the platen roller 14 integrally with the head arm 15 by control of a cam gear or the like and is pushed toward the platen roller 14 by rotating the thermal head 13 counterclockwise around the rotation center 15*b*.

Further, a feeding-side ink sheet bobbin 17 to contain an ink sheet 16 and a winding-side ink sheet bobbin 18 to wind the used ink sheet 16 are provided and the ink sheet 16 passes between the thermal head 13 and the platen roller 14. Each of the ink sheet bobbins 17, 18 is enclosed with an ink sheet case 19 to protect the ink sheet 16.

The thermal head 13 includes a heating unit having a plurality of heating elements and heats heating elements selectively based on a signal of a control circuit board (not illustrated) to thermally transfer ink which is uniformly applied to the ink sheet 16, to the roll paper 20. More specifically, ink can be thermally transferred to the roll paper 20 by pressing the thermal head 13 against the platen roller 14 to bring the ink sheet 16 unwound and fed from the feeding-side ink sheet bobbin 17 into contact with the roll paper 20 by appropriate pressure at appropriate temperature.

When recording is made in full color, three colors of yellow, magenta, and cyan are applied to the ink sheet 16 in turn and a full-color image is formed by thermally transferring each color repeatedly. When the thermal transfer of one color is completed, the capstan roller 23 is rotated backward to return the tip of the roll paper 20 to a record start position of the thermal head 13 once and then the capstan roller 23 is rotated forward to start the thermal transfer of the second color. When the thermal transfer of the three colors is completed following the similar procedure, lastly a recorded portion is overcoated with a protective film similarly by the thermal transfer to complete the recording.

A guide member 25 to convey the roll paper 20 and a roller pair R2 of a discharge roller 26 and a driven roller 27 positioned opposite to the discharge roller 26 across the conveyance route of the roll paper 20 are provided downstream from the thermal head 13 and the platen roller 14. After recording of the roll paper 20 is completed with the thermal transfer method by the thermal head 13, the roll paper 20 passes through the guide member 25 and is sandwiched between the discharge roller 26 and the driven roller 27 and conveyed further downstream by the discharge roller 26 being rotated.

Downstream from the roller pair R2, a movable cutter edge 30 that can move substantially in the horizontal direction and a cutter unit 38 having a fixed cutter edge 31 are provided. The fixed cutter edge is positioned opposite to the movable cutter edge 30 across the conveyance route of the roll paper 20. Downstream from the cutter unit 38, an ejection assisting member 32 coupled to the movable cutter edge 30 is provided to eject a cut recorded portion (recorded matter as cut paper) 20*a* to the containing portion 2 described below. The roll paper 20 is cut by two edges of the movable cutter edge 30 and the fixed cutter edge 31, which make friction like scissors. In the present exemplary embodiment, the roll paper 20 moves upward from below substantially in the vertical direction and a cutting edge of the movable cutter edge 30 can cut the paper satisfactorily by touching the roll paper 20 from a direction perpendicular thereto. Thus, the movable cutter edge 30 and the fixed cutter edge 31 are configured to be positioned substantially horizontally and to move substantially in the horizontal direction.

The containing portion 2 to receive the recorded matter as cut paper 20*a* is provided at the edge of the downstream side. In FIG. 1, a bundle 3 of the recorded matter as cut paper 20*a* is contained in the containing portion 2.

A tip of an ejection portion 11*a* is positioned inside the printer. The ejection portion 11*a* is curbed toward the containing portion 2 and provided at an edge on the containing portion 2 side of the front cover 11, so that the recorded matter as cut paper 20*a* is ejected toward the containing portion 2.

A cut piece collecting portion 33 having a cut piece collecting space 34, which is a space to store cut pieces, is provided between the cutter unit 38 and the containing portion 2. An opening 37 of the cut piece collecting portion 33 is positioned above the conveyance route of the roll paper 20. Further, a cut piece collecting portion cover 35 having a rotation center 35*a* is provided in the containing portion 2 and the opening 37 of the cut piece collecting portion 33 can be opened/closed by the cut piece collecting portion cover 35. In FIG. 1, the opening 37 is closed.

Next, the cutter unit 38 and the cut piece collecting portion cover 35 will be described with reference to FIGS. 2 to 4.

Figure 2A:
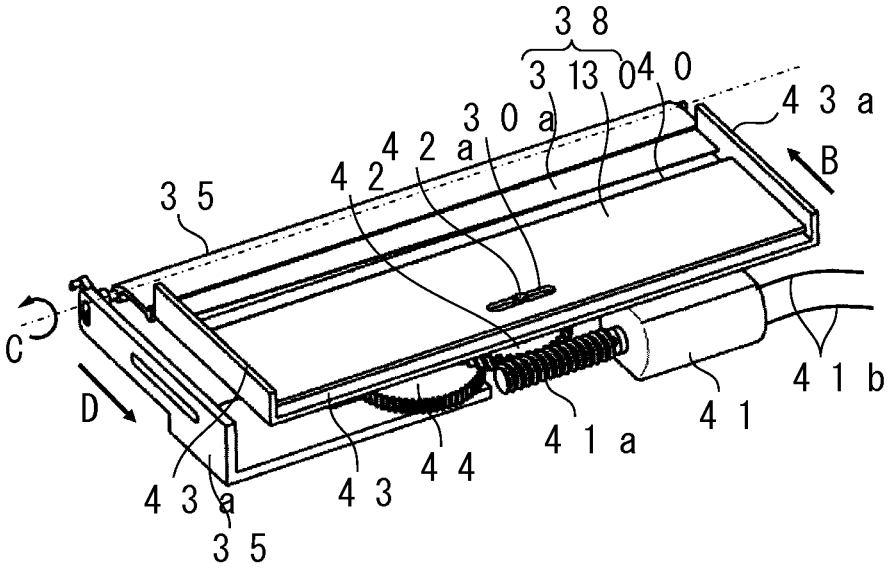
FIGS. 2A and 2B are enlarged schematic diagrams of a periphery of a cutter unit when a movable cutter edge is in a standby state.
Figure 2B:
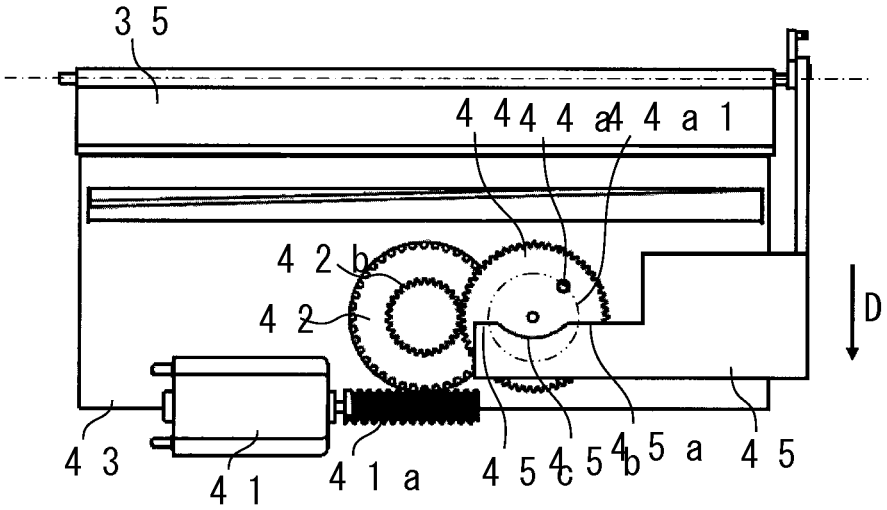

FIG. 2 is an enlarged schematic diagram of periphery of the cutter unit 38 in a state where the movable cutter edge 30 is in a standby position and FIG. 2A is a schematic diagram when viewed from above and FIG. 2B is a schematic diagram when viewed from below.

A gap 40 between the fixed cutter edge 31 and the movable cutter edge 30 in the standby position is located in the conveyance route of the roll paper 20. If the roll paper 20 is positioned in the gap 40 and the movable cutter edge 30 moves in the direction of an arrow B, the roll paper 20 is cut by the cutter unit 38.

Further, a drive motor 41 to which a worm gear 41*a* is connected is provided and the drive motor 41 is connected to a main control circuit board (not illustrated) via a wiring material 41*b*. The drive motor 41 is driven when an electric signal is received from the main control circuit board via the wiring material 41*b*.

The worm gear 41*a* engages with a movable cutter edge drive gear 42 and the movable cutter edge drive gear 42 is provided with a movable cutter edge drive gear pin 42*a* at a position apart from the rotation center on the side of a support member 43 described below. The movable cutter edge drive gear pin 42*a* is inserted into a long hole 30*a* provided at the movable cutter edge 30. The worm gear 41*a* driven and rotated by the motor 41 rotates the movable cutter edge drive gear 42. The movable cutter edge drive gear pin 42*a* that rotates in synchronization with the movable cutter edge drive gear 42 causes the movable cutter edge 30 to reciprocate in the direction of the arrow B and the opposite direction thereof.

The cutter unit 38 is mounted and supported on one side of the support member 43 and the movable cutter edge drive gear 42 is provided on the other side. A vertical wall 43*a* is provided on the flank of the support member 43 to restrict movement of the movable cutter edge 30 to the direction of the arrow B and the opposite direction thereof.

An inner circumferential gear 42*b* whose center is the same as that of the movable cutter edge drive gear 42 is provided on the surface of the movable cutter edge drive gear 42 on the opposite side of the movable cutter edge 30. The inner circumferential gear 42*b* engages with a lever member drive gear 44. A lever member drive gear pin 44*a* that can come into contact with the lever member 45 protrudes from the surface of the lever member drive gear 44 on the opposite side of the support member 43. A trajectory 44*a*1 of the lever member drive gear pin 44*a* followed when the lever member drive gear 44 rotates is indicated by a chain double-dashed line. The lever member 45 coupled to the cut piece collecting portion cover 35 is designed to open the cut piece collecting portion cover 35 to release the opening 37 when the lever member 45 is moved in the direction of an arrow D. Since the cut piece collecting portion cover 35 is pushed in the closing direction by a spring 46, the lever member 45 is pushed in the opposite direction of the arrow D. Details of this mechanism will be described with reference to FIGS. 3 and 4. Surfaces with which the lever member drive gear pin 44*a* of the lever member 45 comes into contact include linear portions 45*a*, 45*c* extending in the width direction (horizontal direction in the figures) of the roll paper 20 and a curved portion 45*b* having the same curvature as a trajectory 44*a* ' of the lever member drive gear pin 44*a*. More specifically, the portions 45*a*, 45*b*, 45*c* with which the lever member drive gear pin 44*a* of the lever member 45 comes into contact constitute a cam portion having a cam shape.

Figure 3:
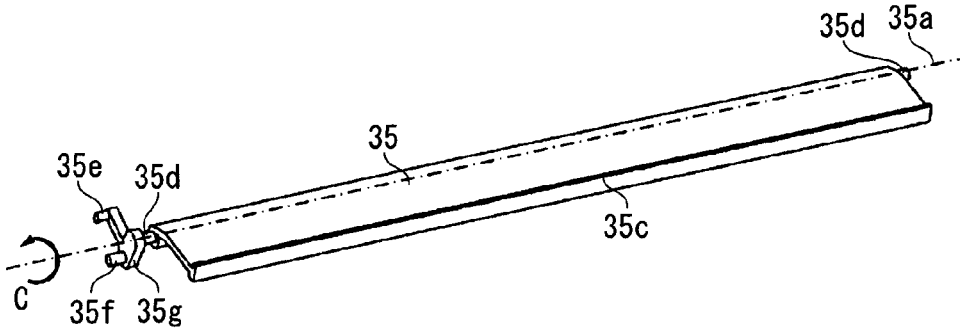
FIG. 3 is a schematic perspective view of a cut piece collecting portion cover.

FIG. 3 is a schematic perspective view of the cut piece collecting portion cover 35. The rotation center 35*a*, in other words, a rotation support member 35*d* serving as a rotation shaft is provided at an edge of the cut piece collecting portion cover 35 and the cut piece collecting portion cover 35 is pivotally supported by the containing portion 2 (see FIG. 4). Rotated in the direction of an arrow C, the cut piece collecting portion cover 35 is opened to release the opening 37. An arm portion 35*g* is provided outside the rotation support member 35*d* and a hook 35*e* and a pin 35*f* are provided in the arm portion 35*g*. In addition, a protrusion 35*c* that protrudes in the same direction as the direction of rotation when the cut piece collecting portion cover 35 is opened is provided at an edge opposite to the edge serving as the rotation center of the cut piece collecting portion cover 35.

Figure 4:
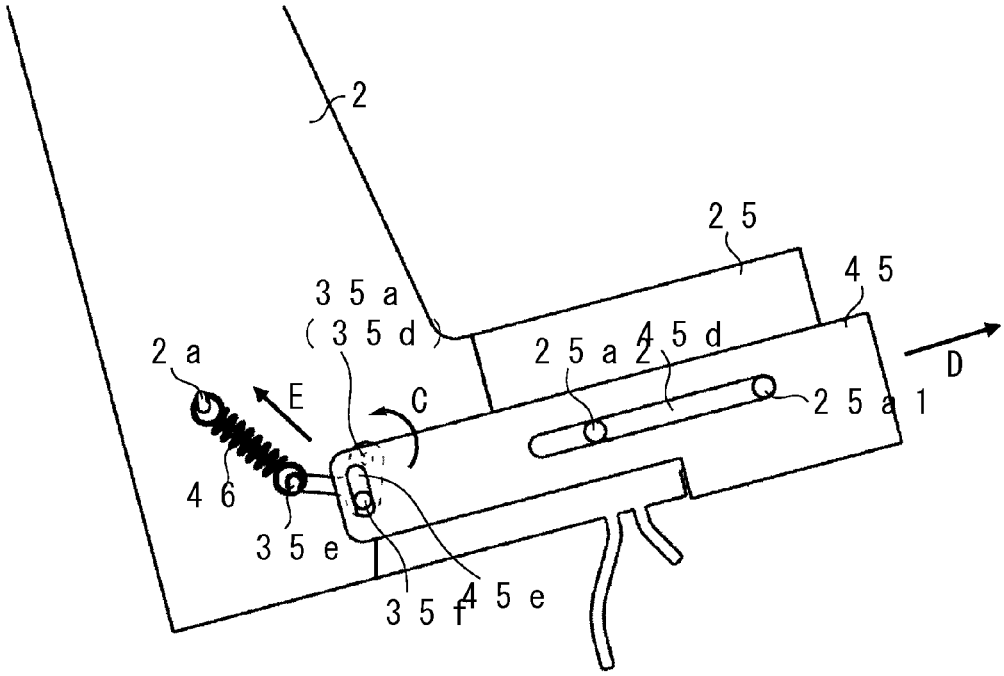
FIG. 4 is a diagram illustrating an opening/closing operation of the cover of the cut piece collecting portion by movement of a lever member.

FIG. 4 is a diagram illustrating an opening/closing operation of the cut piece collecting portion cover 35 when the lever member 45 is moved.

A hook 2*a* protrudes from the side face outside the containing portion 2. The arm portion 35*g* of the cut piece collecting portion cover 35 protrudes from the containing portion at the position of the rotation support member 35*d* via the side face of the containing portion 2. A tensile force pulling in the direction of an arrow E acts and the spring 46 prompting the closing operation of the cut piece collecting portion cover 35 is locked by the hook 2*a* and the hook 35*e* provided in the arm portion 35*g* of the cut piece collecting portion cover 35. A long hole 45*e* is provided in the lever member 45 and the pin 35*f* protruding from the arm portion 35*g* of the cut piece collecting portion cover 35 is inserted into the long hole 45*e*.

The opening/closing operation of the cut piece collecting portion cover will be described with reference to FIGS. 2 to 4. When the lever member drive gear 44 rotates clockwise from the position illustrated in FIG. 2B, the lever member drive gear pin 44*a* first comes into contact with the linear portion 45*a*. When the lever member drive gear 44 further rotates, the lever member drive gear pin 44*a* moves from the linear portion 45*a* to the curved portion 45*b* while moving the lever member 45 in the direction of the arrow D. When the lever member 45 moves in the direction of the arrow D, the pin 35*f* illustrated in FIG. 4 is pressed into an inner surface of the long hole 45*e* and the cut piece collecting portion cover 35 rotates in the direction of the arrow C around the rotation center 35*a* to open the cut piece collecting portion cover 35. The movement direction of the lever member 45 is restricted by a long hole 45*d* provided in the lever member 45 and pins 25*a*1, 25*a*2 protruding from the side face of the guide member 25 inserted into the long hole 45*d*.

When the lever member drive gear pin 44*a* comes to the position of the curved portion 45*b*, the lever member drive gear pin 44*a* moves along the curved portion 45*b* to the linear portion 45*c* because the curvature of the curved portion 45*b* is the same as that of the trajectory 44*a*1 of the lever member drive gear pin 44*a*. Thus, the movement of the lever member 45 stops. In other words, the cut piece collecting portion cover remains open.

When the lever member drive gear pin 44*a* comes to the position of the linear portion 45*c*, the lever member 45 starts to move in the opposite direction of the arrow D because the lever member 45 is pushed in the opposite direction of the arrow D. Then, the cut piece collecting portion cover 35 rotates around the rotation center 35*a* in the opposite direction of the arrow C to close the cut piece collecting portion cover. A cam mechanism may be formed by using a cam gear instead of the lever member drive gear 44. In addition, by changing the shape of the cam, timing of operations of the movable cutter edge 30 and the cut piece collecting portion cover 35 can be adjusted.

By making the teeth of the lever member drive gear 44 twice as many as the teeth of the inner circumferential gear 42*b*, the number of revolutions of the lever member drive gear 44 becomes half the number of revolutions of the movable cutter edge drive gear 42. More specifically, each time the cutting operation of the movable cutter edge 30 is performed twice, the opening/closing operation of the cut piece collecting portion cover 35 coupled to the lever member 45 is performed once.

However, the ratio of the number of times of the cutting operation of the movable cutter edge 30 to that of the opening/closing operation of the cut piece collecting portion cover 35, that is, the rotation speed ratio, can freely be set by changing the numbers of teeth of the movable cutter edge drive gear 42 and the lever member drive gear 44. In other words, the cut piece collecting portion cover 35 can be opened/closed once for any plural number of times of driving of the movable cutter edge 30. The numbers of teeth (rotation speed ratio) of the gears 42, 44 are determined based on the number of times of driving the movable cutter edge 30 in a period between when the recorded matter as cut paper 20*a* is cut and when the following record is made on the unrecorded roll paper 20. Then, by determining the shape of the cam so that the cut piece collecting portion cover 35 is opened in time for generation of a cut piece 20*b*, the present invention can be applied also to printers whose recording procedure is different from that of the present exemplary embodiment.

The mechanism to link the movable cutter edge 30 with the cut piece collecting portion cover 35 is not limited to the configuration in the present exemplary embodiment. Any linkage mechanism that can open the cut piece collecting portion cover 35 in predetermined timing (in the ratio of once to twice, for example) with regard to movement of the movable cutter edge 30 can be used.

Next, the cutting method of the roll paper 20 and the operation of the cut piece collecting portion cover 35 will be described with reference to FIGS. 5 to 9.

Figure 5:
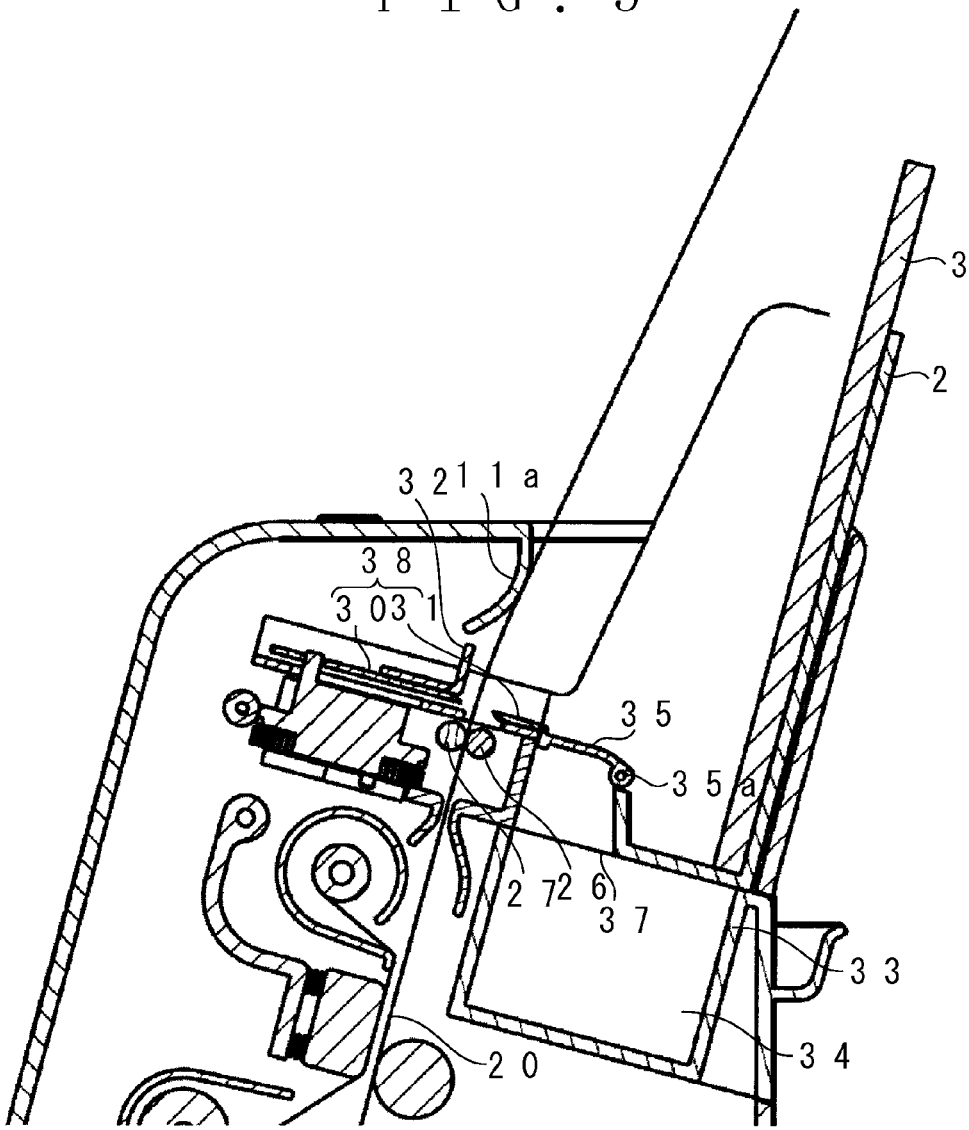
FIG. 5 is a schematic diagram of a state immediately before a recorded roll paper is cut.

FIG. 5 is a schematic diagram of a state immediately before a recorded portion of the roll paper 20 is cut. Before the recorded portion of the roll paper 20 is cut, the cut piece collecting portion cover 35 is in a state (closed state) in which the opening 37 of the cut piece collecting portion 33 is closed. The recorded portion of the roll paper 20 is protruded from the cutting position for the cutter unit 38 and the rear end of the recorded portion of the roll paper 20 is positioned upstream from the cutting position for the cutter unit 38. Then, by moving the movable cutter edge 30 to the fixed edge 31 from this state, the roll paper 20 is cut and the recorded matter as cut paper 20*a* (see FIG. 6) is obtained.

Figure 6:
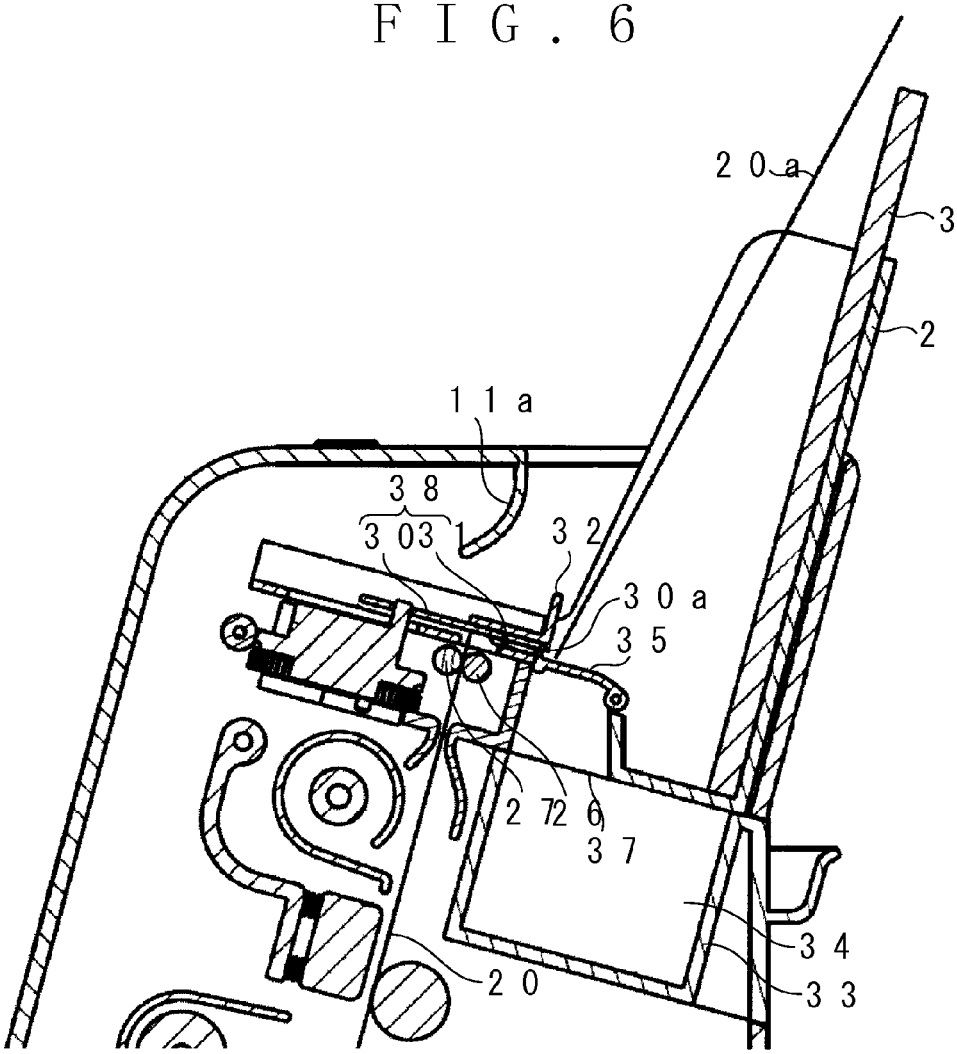
FIG. 6 is a schematic diagram of the state immediately after the recorded roll paper is cut.

FIG. 6 is a schematic diagram of the state immediately after the recorded matter as cut paper 20*a* is cut and clipped by the recorded portion of the roll paper 20. Even in this state, by maintaining the opening 37 of the cut piece collecting portion 33 closed with the cut piece collecting portion cover 35, the entry of the recorded matter 20*a* into the cut piece collecting portion 33 can be restricted. The movable cutter edge 30 moves from the standby position located apart from the cut piece collecting portion cover 35, overlaps with the fixed edge 31, and further moves up to the position in which a tip 30*a* of the movable cutter edge 30 overlaps with a portion of the cut piece collecting portion cover 35. In this manner, the recorded matter as cut paper 20 is ejected up to the upper surface of the cut piece collecting portion cover 35 in the direction toward the containing portion 2 by the ejection assisting member 32.

Figure 7:
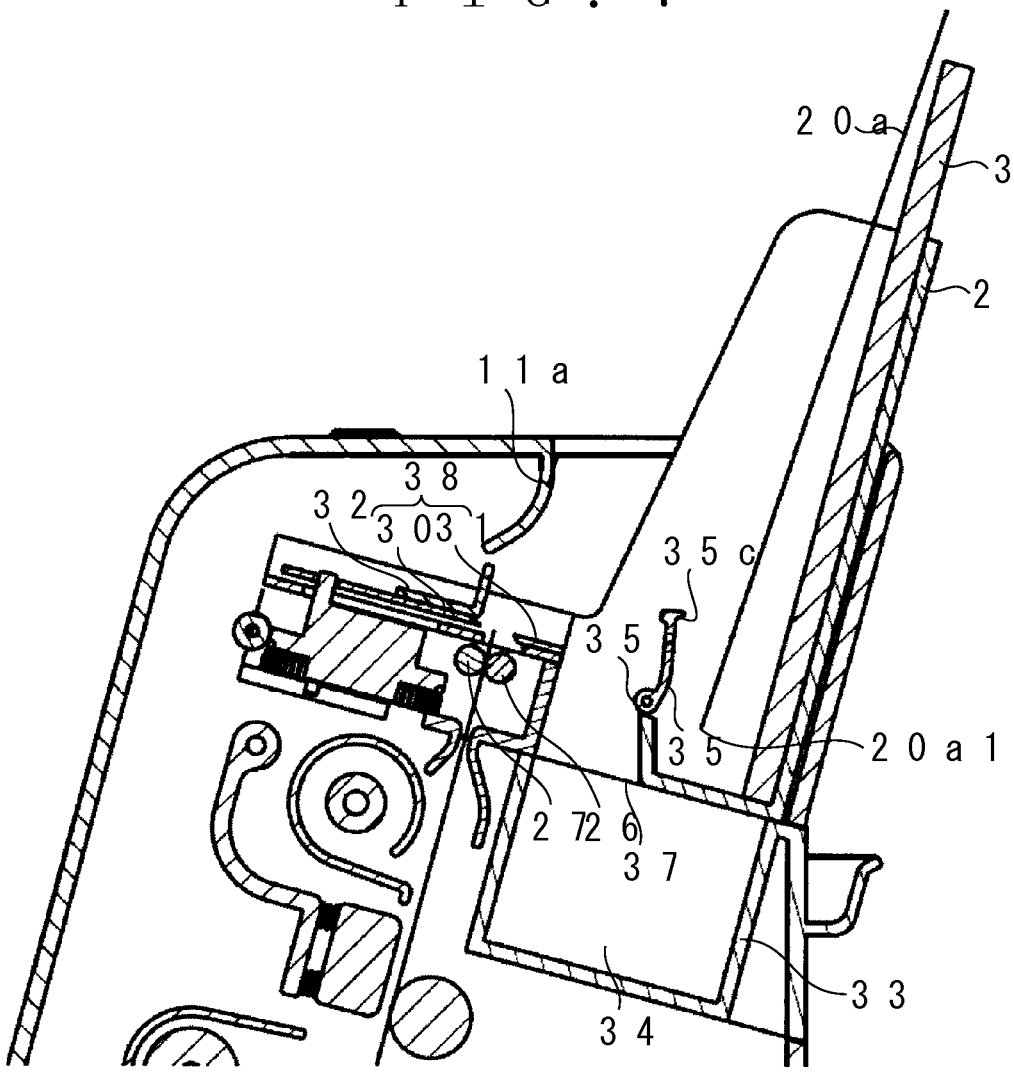
FIG. 7 is a schematic diagram of the state in which the cover of the cut piece collecting portion is open.
Figure 10:
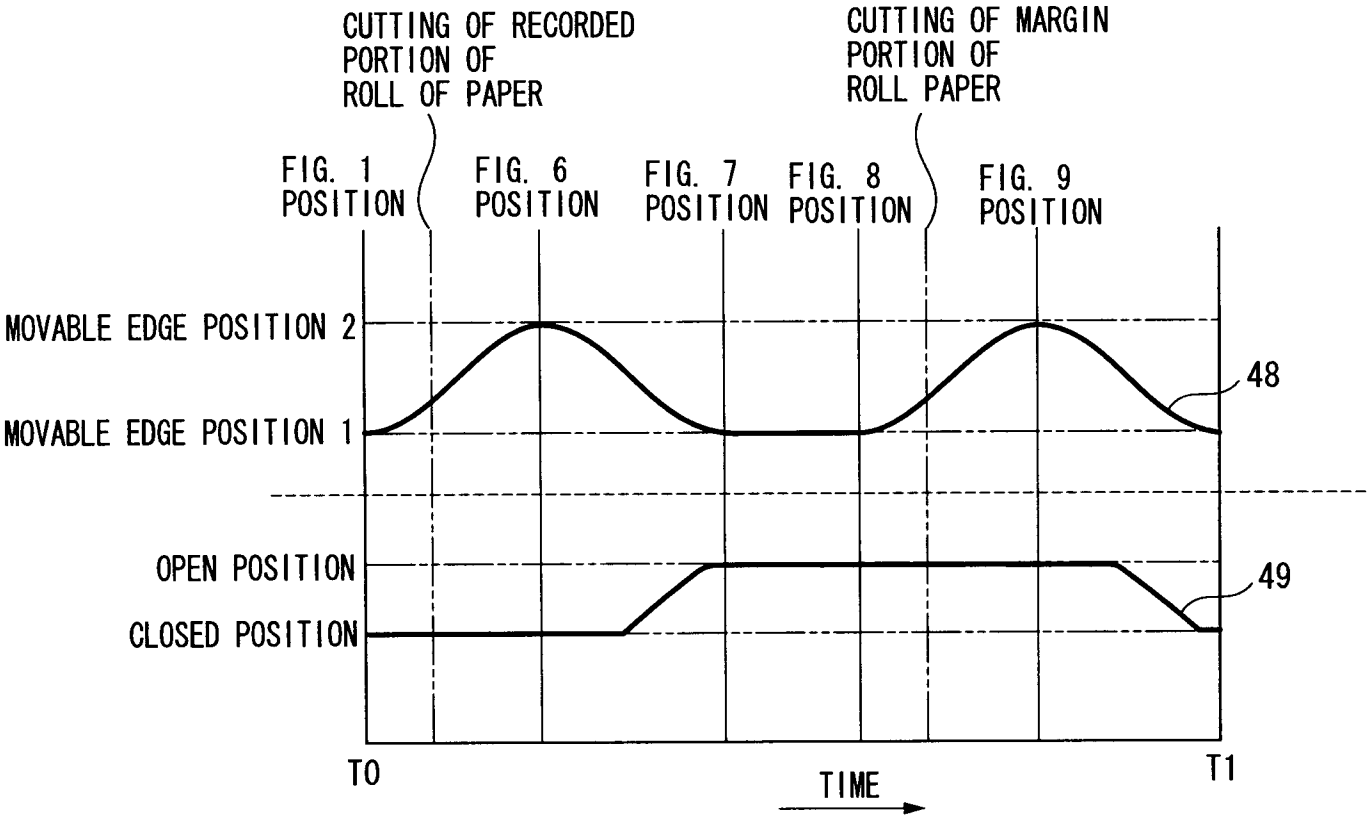
FIG. 10 is a timing chart of movement of the movable cutter edge and the opening/closing of the cover of the cut piece collecting portion.

FIG. 7 is a schematic diagram of the state in which the cut piece collecting portion cover 35 is open. A while after the movable cutter edge 30 starts to return to the standby position which is a position before the movement, the cut piece collecting portion cover 35 rotates around the rotation center 35*a* clockwise in the figure, as described below, to be in a state (open state) in which the opening 37 of the cut piece collecting portion 33 is open. The timing when the movable cutter edge 30 returns to the standby position and the timing when the cut piece collecting portion cover 35 is opened will be described below using the timing chart in FIG. 10 illustrating the linkage of the movable cutter edge 30 and the cut piece collecting portion cover 35.

When the cut piece collecting portion cover 35 is opened, a rear end 20*a*1 of the recorded matter as cut paper 20*a* is kicked off toward the cut piece collecting portion cover 35 and ejected to the side of the containing portion 2.

If the opening angle (rotation angle) of the cut piece collecting portion cover 35 is the same, the amount of movement of the cut piece collecting portion cover 35 is smaller if the distance from the rotation center 35*a* of the cut piece collecting portion cover 35 is shorter compared with a case where the distance from the rotation center 35*a* is longer. Thus, by tilting an edge 35*h* on the side of the rotation center 35*a* of the cut piece collecting portion cover 35 more downward compared with other portions, a problem that the recorded matter as cut paper 20*a* is hung near the rotation center 35*a* where an amount of movement is small and does not fall can be prevented. The recorded matter as cut paper 20*a* can be sent out even with a small opening angle, which contributes to space saving.

As described above, the protrusion 35*c* protruding from the upper surface of the cut piece collecting portion cover 35 is provided at the tip of the cut piece collecting portion cover 35. Since the rear end 20*a*1 of the recorded matter as cut paper 20*a* is hooked by the protrusion 35*c*, the recorded matter as cut paper 20*a* can be sent out to the side of the containing portion 2 more reliably.

Figure 8:
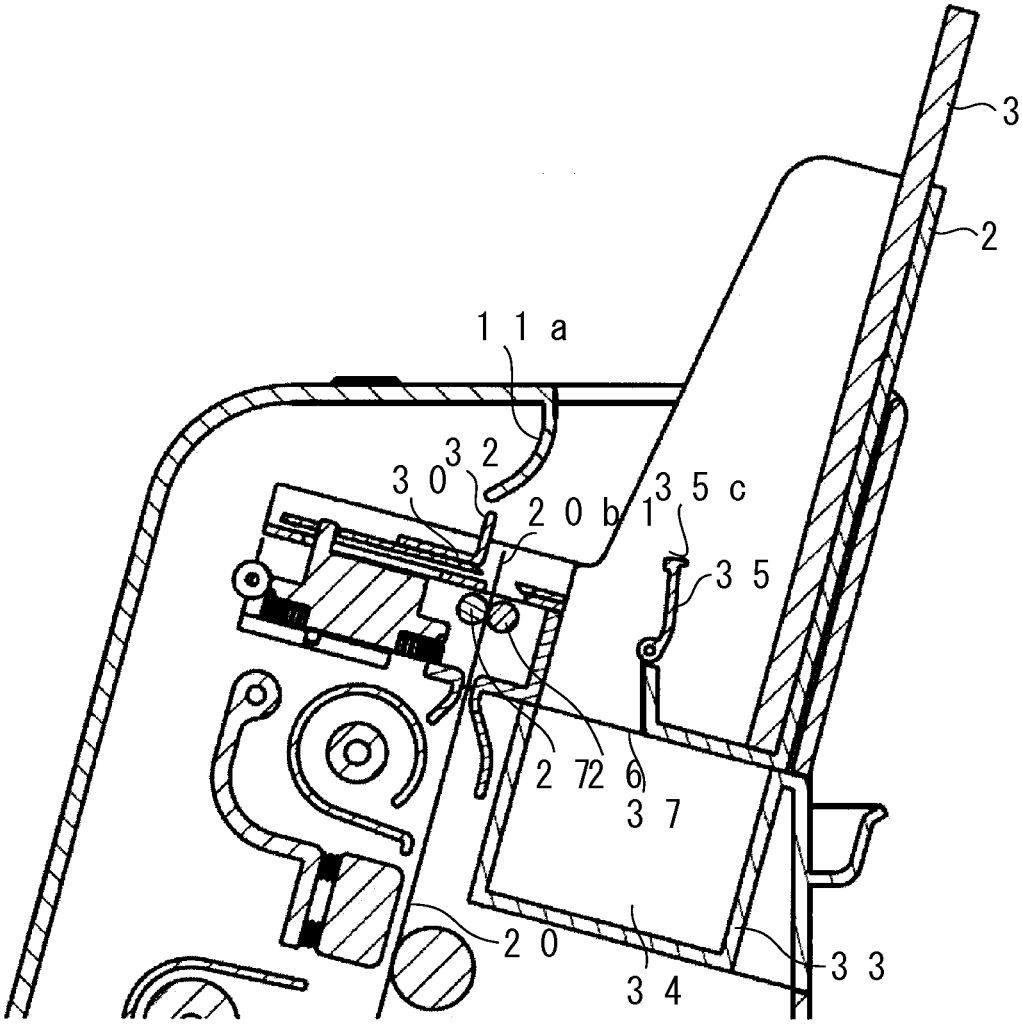
FIG. 8 is a schematic diagram of the state immediately before a margin portion is cut.

FIG. 8 is a schematic diagram of the state immediately before the remaining recorded portion and a small unrecorded portion of the roll paper 20 is cut as a margin portion 20*b*1. The roll paper 20 is sent out by rotation of the discharge roller 26 and protrudes from the cutting position of the cutter unit 38 by the length of the margin portion 20*b*1. More specifically, the rear end of the recorded portion of the roll paper 20 remaining after cutting is positioned downstream from the cutting position of the cutter unit 38. Further, the cut piece collecting portion cover 35 is maintained open and the opening 37 of the cut piece collecting portion 33 is maintained released. The movable cutter edge 30 is moved in this state to cut the margin portion 20*b*1 by the movable cutter edge 30 and the fixed cutter edge 31. Then, the margin portion 20*b*1 separated from the roll paper 20 becomes the cut piece 20*b* (see FIG. 9).

Figure 9:
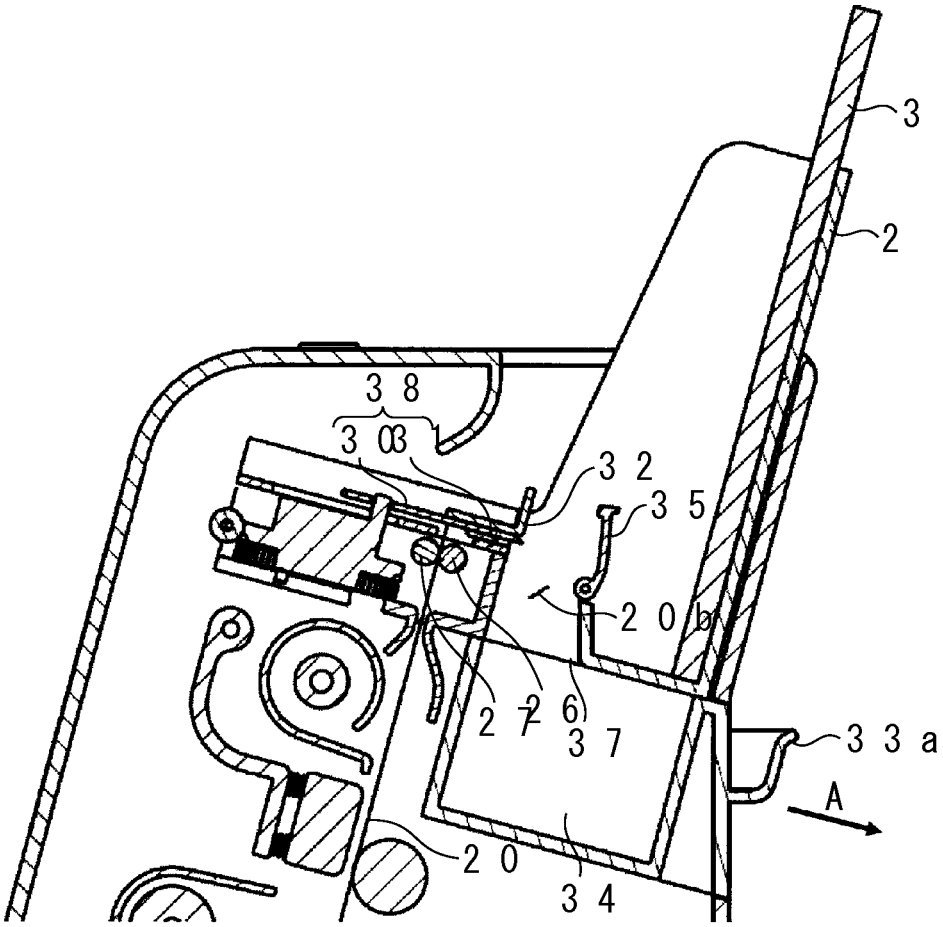
FIG. 9 is a schematic diagram illustrating how a cut piece is collected into a cut piece collecting space.

FIG. 9 is a schematic diagram illustrating how the cut piece 20*b* is collected into the cut piece collecting space 34. The cut piece collecting portion 33 is provided with a handle 33*a* and cut pieces accumulated in the cut piece collecting portion 33 can be dumped by pulling out the handle 33*a* in the direction of an arrow A.

Like the recorded matter 20*a*, the cut piece 20*b* is ejected toward the side of the containing portion 2 by the ejection assisting member 32 coupled to the movable cutter edge 30. However, in contrast to the recorded matter as cut paper 20*a*, the cut piece collecting portion cover 35 is open and the opening 37 of the cut piece collecting portion 33 is released. Thus, instead of being sent to the containing case 2, the cut piece 20*b* falls via the opening 37 to be collected by the cut piece collecting space 34 of the cut piece collecting portion 33.

A while after the movable cutter edge 30 starts to return to the standby position, the cut piece collecting portion cover 35 starts to close, as described below, to be in the standby state (see FIG. 1) before recording is made on the roll paper 20. Even if the cut piece 20*b* should be caught near the opening 37, the cut piece 20*b* can be ejected to the cut piece collecting space 34 when the cut piece collecting portion cover 35 closes.

Next, the timing of the movement operation of the movable cutter edge 30 described above and the opening/closing operation of the cut piece collecting portion cover 35 linked thereto will be described in more detail.

FIG. 10 is a timing chart of the movement of the movable cutter edge 30 and the opening/closing operation of the cut piece collecting portion cover 35. In both curves, the horizontal axis represents the time. A curve 48 represents the position of the movable cutter edge 30 by the vertical axis, and a curve 49 represents the opening angle of the cut piece collecting portion cover 35 by the vertical axis. A movable cutter edge position 1 is the position in the standby state (see FIG. 5) when the roll paper 20 is conveyed. A movable cutter edge position 2 is the position after the movable cutter edge 30 has moved to a maximum extent, more specifically, the position where the tip of the movable cutter edge 30 overlaps with the cut piece collecting portion cover 35 (see FIG. 6). Time T0 indicates the time when the movable cutter edge 30 starts to move to cut a recorded portion of the roll paper 20 and time T1 indicates the time when the movable cutter edge 30 returns to the standby state after cutting the margin portion 20*b*1. After T1 has elapsed, recording is made again and when the recorded roll paper is cut, the movable cutter edge 30 returns to the state of T0.

Operations in one cycle will briefly be described below.

The movable cutter edge 30 moves from the standby position (state in FIG. 5) and a recorded portion of the roll paper 20 is cut (the recorded matter as cut paper 20*a*) to reach the movable cutter edge position 2 (state in FIG. 6), which is the position after the movable cutter edge 30 has moved to a maximum extent. Next, the movable cutter edge 30 starts to return to the standby position. When the movable cutter edge 30 reaches an approximately intermediate position between the position after the maximum movement (movable cutter edge position 2) and the standby position (movable cutter edge position 1), the cut piece collecting portion cover 35 starts to open and, as illustrated in FIG. 7, the cut piece collecting portion cover 35 becomes fully open. At this point, the recorded matter as cut paper 20*a* is slid into the containing case 2 by the cut piece collecting portion cover 35 and the ejection assisting member 32. Then, as illustrated in FIG. 8, the margin portion 20*b*1 of the roll paper 20 which is to be disposed of as cut pieces is conveyed. The movable cutter edge 30 starts to move again, the margin portion 20*b*1 is cut, and the movable cutter edge 30 reaches the movable cutter edge position 2 (state in FIG. 9). At this point, the cut margin portion 20*b* is ejected by the movable cutter edge 30 and the ejection assisting member 32 to fall from the opening 37 into the cut piece collecting space 34. Next, the movable cutter edge 30 starts to return to the standby position. When the movable cutter edge 30 reaches an approximately intermediate position between the position after the maximum movement (movable cutter edge position 2) and the standby position (movable cutter edge position 1), the cut piece collecting portion cover 35 starts to close. Then, as illustrated in FIG. 1, the cut piece collecting portion cover 35 is closed completely and the movable cutter edge 30 reaches the movable cutter edge position 1, which is the standby position. In this manner, operations of one cycle are performed. More specifically, the cut piece collecting portion cover 35 performs the opening/closing operation once for the recording operation to form one piece of recorded matter 20*a*.

Next, a structure that enables the cut piece collecting portion cover 35 to open/close without the spring 46 pushing the cut piece collecting portion cover 35 in the closing direction will be described with reference to FIG. 11.

Figure 11:
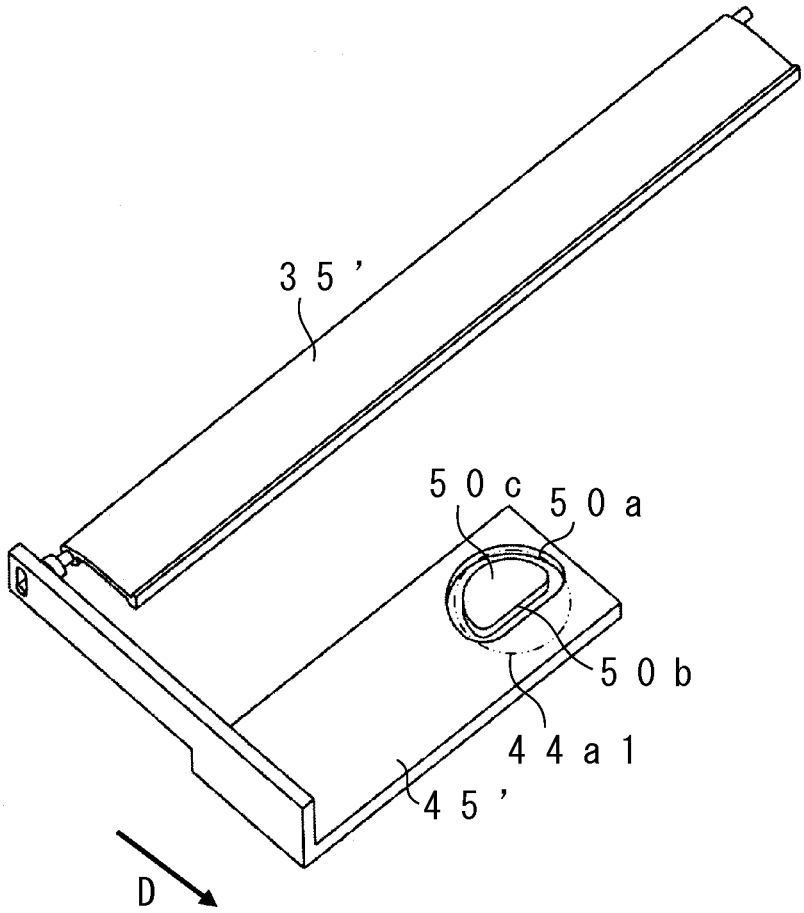
FIG. 11 is a schematic perspective view of the cover of the cut piece collecting portion and the lever member.

FIG. 11 is a schematic perspective view of a cut piece collecting portion cover 35' and a lever member 45'. The lever member 45' is provided with a cam groove 50*a*. The lever member drive gear pin 44*a* (see FIG. 2B) of the lever member drive gear 44 (see FIG. 2B) is inserted into the cam groove 50*a*. A center 50*c* of an arc portion of the cam groove 50*a* is located at a position matching the rotation center of the lever member drive gear 44. When the lever member drive gear 44 rotates, the lever member drive gear pin 44*a* moves inside the cam groove 50*a* along a trajectory 44*a*1 indicated by a chain double-dashed line. At this point, when the lever member drive gear pin 44*a* moves in a linear portion 50*b*, the lever member drive gear pin 44*a* pushes the linear portion 50*b* in the direction of the arrow D so that the cut piece collecting portion cover 35' performs an opening operation. When the lever member drive gear pin 44*a* moves in a curved portion 50*d* after passing through the linear portion 50*b*, the lever member drive gear pin 44*a* pushes the curved portion 50*d* in the opposite direction of the arrow D so that the cut piece collecting portion cover 35' performs a closing operation.

In this manner, the closing operation of the cut piece collecting portion cover 35' can be performed by the cam groove 50*a* even without the spring to push the cut piece collecting portion cover 35' in the closing direction.

Next, the shape of the movable cutter edge 30 that achieves almost the same effect without using the ejection assisting member 32 will be described with reference to FIG. 12.

Figure 12:
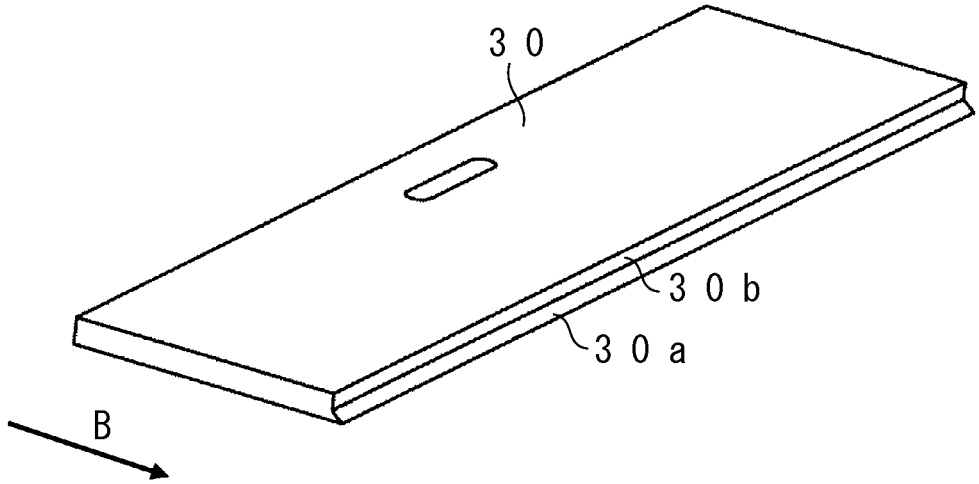
FIG. 12 is a schematic diagram of the movable cutter edge.

FIG. 12 is a schematic diagram of the movable cutter edge 30. The movable cutter edge 30 cuts the roll paper 20 by moving in the direction of the arrow B. Edge surfaces of the movable cutter edge 30 are configured with a cutting edge surface 30*a* and a surface 30*b* whose angle is more acute than that of the cutting edge surface 30*a*, instead of making edge surfaces flat. In this manner, when portions to be the recorded matter as cut paper 20*a* or the cut piece 20*b* are cut from the roll paper 20, the recorded matter as cut paper 20*a* or the cut piece 20*b* can be prevented from going up along the edge surface of the movable cutter edge 30.

Accordingly, almost the same effect can be achieved compared to a case where the recorded matter as cut paper 20*a* or the cut piece 20*b* is prevented from going up along the edge surface of the movable cutter edge 30 by the ejection assisting member 32, making the ejection assisting member 32 unnecessary and contributing to the reduction in the number of parts.

When a portion to be the recorded matter as cut paper 20*a* or the margin portion 20*b*1 of the roll paper 20 is cut, the portion may not be cut by one operation of the movable cutter edge 30 so that the cutting operation needs to be performed again by moving the movable cutter edge 30. In this case, the timing of opening/closing the cut piece collecting portion cover 35 and the timing of conveying the roll paper 20 become misaligned. More specifically, for example, the cut piece 20*b* is generated while the cut piece collecting portion cover 35 is closed. In such a case, before a portion to be the recorded matter as cut paper 20*a* or the cut piece 20*b* is cut, the movable cutter edge 30 may be driven once to correct timing shifts. For example, a sensor is arranged near the cut piece collecting portion cover to detect the position of the cut piece collecting portion cover (open/closed state). If the cut piece collecting portion cover is not located at the position at which the cut piece collecting portion cover should be located, it is determined that the timing is shifted and the movable cutter edge may be driven once. When the movable cutter edge is driven, the roll paper is once pulled back into the printer by the discharge roller 26 or the like so that the roll paper is not cut if the movable cutter edge is moved and then, the movable cutter edge is driven once. Then, the roll paper is conveyed to the cutting position again and the movable cutter edge is driven to repeat the failed cutting operation. In the present exemplary embodiment, the cut piece collecting portion cover 35 is opened/closed once for two cutting operations and thus, timing shifts can be corrected by actually cutting the roll paper in the second driving after driving the movable cutter edge once. However, if the cut piece collecting portion cover 35 is opened/closed once for three cutting operations, timing shifts can be corrected by cutting the roll paper in the third driving of the movable cutter edge after driving the movable cutter edge twice in a state in which the roll paper is not cut. The roll paper is actually cut during the cutting operation when timing shifts are corrected and thus, the recorded matter 20*a* and cut piece 20*b* will be contained in the right location.

If power is turned off while the timing of opening/closing the cut piece collecting portion cover 35 and the timing of conveying the roll paper 20 are misaligned as described above, whether the timing of opening/closing the cut piece collecting portion cover 35 and the timing of conveying the roll paper 20 match is detected after power-on or before recording is started. If a timing shift is detected, only the movable cutter edge 30 is driven once to correct the timing. Whether the timing is correct may be detected by, for example, the rotation position of the lever member drive gear 44 or the position of the cut piece collecting portion cover 35.

In a printer according to the present invention, as described above, the cut piece collecting portion 33 to collect the cut piece 20*b* can be disposed in a lower part while the upward ejection is employed and further the opening 37 of the cut piece collecting portion 33 can be opened/closed by using the cut piece collecting portion cover 35. Thus, the collected cut piece 20*b* can be prevented from being scattered. Moreover, since activation of movable cutter edge 30 and the cut piece collecting portion cover 35 is mutually linked, the timing of activation of the movable cutter edge 30 and the cut piece collecting portion cover 35 can easily be adjusted.

Next, another exemplary embodiment of the printer according to the present invention will be described.

A printer that discharges recorded matter in the horizontal direction will be described with reference to FIGS. 13 and 14. The printer in the present exemplary embodiment has a form obtained by tilting a printer in the above exemplary embodiment so that the ejection direction becomes the horizontal direction and has the same basic configuration as the printer in the above exemplary embodiment. Thus, only differences from the above exemplary embodiment will be described. Only the cutting process of the roll paper 20 will be described. Processes other than the cutting process are the same as those in the above exemplary embodiment.

Figure 13:
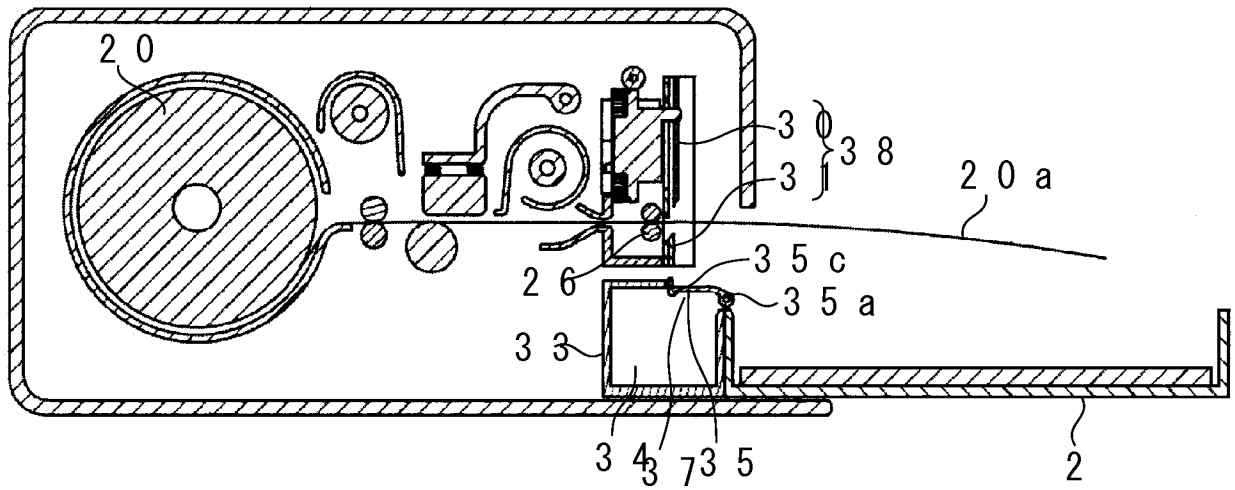
FIG. 13 is a schematic diagram of the cross section of another exemplary embodiment of the printer according to the present invention.

FIG. 13 is a schematic diagram of the cross section of another exemplary embodiment of the printer according to the present invention and illustrates the state immediately before a portion to be the recorded matter as cut paper 20*a* of the roll paper 20 is cut.

In the present exemplary embodiment, the roll paper 20 is conveyed in the horizontal direction. The movable cutter edge 30 and the fixed cutter edge 31 cut the roll paper 20 from a direction perpendicular to the roll paper 20 and thus, the cutter unit 38 is provided in the perpendicular to the roll paper 20. The cut piece collecting portion 33 having the cut piece collecting space 34 is provided between the cutter unit 38 and the containing case 2 on the conveyance route, in other words, below the cutter unit 38 and in contact with the containing case 2. The cut piece collecting portion 33 has the opening 37 between the cutter unit 38 and the containing case 2. The opening 37 is covered with the cut piece collecting portion cover 35 mounted on the containing portion 2 and having the rotation center 35*a*. Like the above exemplary embodiment, the opening 37 of the cut piece collecting portion 33 is opened/closed by the cut piece collecting portion cover 35. In the present exemplary embodiment, the recorded matter as cut paper 20*a* and the cut piece 20*b* (see FIG. 14C) freely fall after being cut by the cutter unit 38 and thus, there is no need to provide the ejection assisting member 32 like the above exemplary embodiment.

Next, the cutting method of the roll paper 20 and the operation of the cut piece collecting portion cover 35 in the present exemplary embodiment will be described with reference to FIG. 14.

Figure 14A:
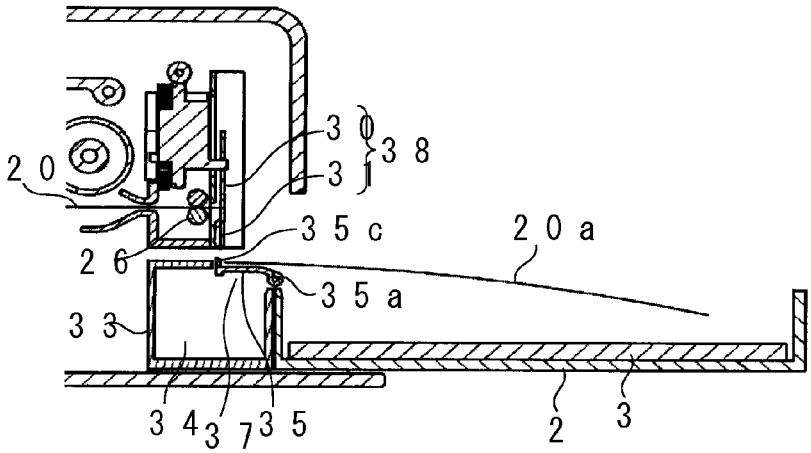
FIGS. 14A, 14B, and 14C are schematic diagrams illustrating a method of cutting the roll paper and the operation of the cover of the cut piece collecting portion in the other exemplary embodiment.

FIG. 14A is a schematic diagram illustrating the state immediately after a portion to be the recorded matter as cut paper 20*a* is cut. If a recorded portion of the roll paper 20 is cut while the cut piece collecting portion cover 35 is closed, the recorded matter as cut paper 20*a* which is cut from the cutting position of the cutter unit 38 freely falls and the rear end of the recorded matter as cut paper 20*a* is on the cut piece collecting portion cover 35.

Figure 14B:
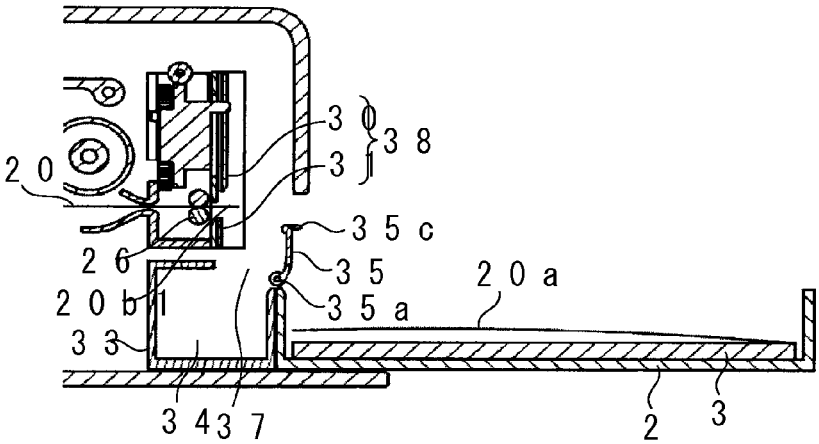

FIG. 14B is a schematic diagram illustrating the state immediately before the margin portion 20*b*1 of the roll paper 20 is cut. The movable cutter edge 30 returns to the standby position from the state illustrated in FIG. 14A in which a portion to be the recorded matter as cut paper 20*a* is cut. Then, when the cut piece collecting portion cover 35 is rotated clockwise around the rotation center 35*a* to open the opening 37, the recorded matter as cut paper 20*a* is kicked in the direction of the containing case 2 by the protrusion 35*c* of the cut piece collecting portion cover 35. Subsequently, the roll paper 20 is sent out by rotation of the discharge roller 26 and the margin portion 20*b*1 is protruded from the cutting position by the cutter unit 38.

Figure 14C:
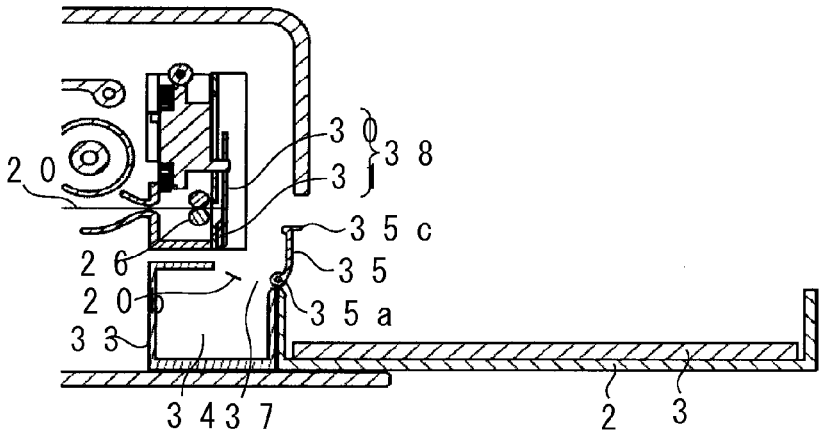

FIG. 14C is a schematic diagram illustrating how the cut piece 20*b* is collected into the cut piece collecting space 34. Because the cut piece collecting portion cover 35 remains open, the opening 37 of the cut piece collecting portion 33 is opened. Thus, the cut piece 20*b*, which is the cut margin portion 20*b*1, is collected into the cut piece collecting space 34 of the cut piece collecting portion 33 via the opening 37 by free falling. Then, after the cut piece collecting portion cover 35 is closed, the following recording is started. In this manner, operations of one cycle are performed.

The timing of the movement of the movable cutter edge 30 and the opening/closing operation of the cut piece collecting portion cover 35 is the same as in the above exemplary embodiment and a description thereof is omitted.

In the foregoing, exemplary embodiments of the present invention have been described, but the present invention is not limited to these exemplary embodiments and can be altered or modified within the scope thereof in various ways.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-147453 filed Jun. 29, 2010, which is hereby incorporated by reference herein in its entirety.

What is claimed is:

1. A printer, comprising:

a printing unit configured to print an image on recording paper;

a cutter unit having a movable cutter configured to cut the recording paper, wherein a portion of the recording paper on which the image is printed is cut as a printed portion and the portion of the recording paper adjacent to the printed portion is cut as a cut piece;

a containing portion that receives the printed portion cut by the cutter unit;

a cut piece collecting portion that collects the cut piece cut by the cutter unit; and a cut piece collecting portion cover that can be opened and/or closed and is opened and/or closed in conjunction with a cutting operation of the cutter unit, wherein when the cut piece collecting portion cover is in an open state, the recording paper cut by the cutter unit is collected by the cut piece collecting portion, when the cut piece collecting portion cover is in a closed state, the recording paper cut by the cutter unit can move to the containing portion of the recording paper since an entry to the cut piece collecting portion is restricted by the cut piece collecting portion cover, the cut piece collecting portion cover performs one opening and closing operation for a predetermined number of cutting operations by the cutter unit, a lever member coupled to the cut piece collecting portion cover, a movable cutter drive gear to drive the movable cutter, and a lever member drive gear to drive the lever member, wherein the movable cutter drive gear and the lever member drive gear are configured to rotate synchronously in a rotation speed ratio corresponding to the predetermined number of cutting operations.

2. The printer according to claim 1, wherein the cutter unit cuts the recording paper containing an edge of the image printed by the printing unit and a margin portion on which the image is not printed, as the cut piece.

3. The printer according to claim 1, wherein the cut piece collecting portion cover is rotatable around a rotation axis provided on a side of the containing portion and the closed state changes to the open state when the cut piece collecting portion rotates to the side of the containing portion, and when the cut piece collecting portion cover rotates from the closed state to the open state, the recording paper on the cut piece collecting portion cover is ejected toward the containing portion.

4. The printer according to claim 3, wherein a protrusion protruding in a direction to open the cut piece collecting portion cover is provided at an edge on the side opposite to the rotation axis of the cut piece collecting portion cover.

5. The printer according to claim 1, wherein the printer generates the printed portion and the cut piece when the cutter unit performs the cutting operation twice for a printing operation to output a sheet of the printed portion, and the cut piece collecting portion cover performs one opening and closing operation for the two cutting operations by the cutter unit.

6. The printer according to claim 1, further comprising a lever member coupled to the cut piece collecting portion cover, a movable cutter drive gear to drive the movable cutter, and a lever member drive gear to drive the lever member, wherein the movable cutter drive gear and the lever member drive gear are configured to rotate synchronously in a rotation speed ratio corresponding to the predetermined number of cutting operations.

7. The printer according to claim 6, wherein the movable cutter drive gear makes one revolution for one cutting operation by the movable cutter and the lever member drive gear makes one revolution for one opening and closing operation of the cut piece collecting portion cover.

8. The printer according to claim 1, wherein the cutter unit performs a first cutting operation to cut the printed portion and a second cutting operation to cut the cut piece, the movable cutter moves from a standby position to a cutting position where the recording paper is cut and then moves from the cutting position to the standby position in one cutting operation by the cutter unit, the cut piece collecting portion cover starts movement from the closed state to the open state while the movable cutter is moving from the cutting position to the standby position in the first cutting operation, and the cut piece collecting portion cover starts the movement from the open state to the closed state while the movable cutter is moving from the cutting position to the standby position in the second cutting operation.

9. The printer according to claim 8, wherein if the movable cutter is at the cutting position in the first cutting operation, the cut piece collecting portion cover is in the closed state, and if the movable cutter is at the cutting position in the second cutting operation, the cut piece collecting portion cover is in the open state.

10. The printer according to claim 8, wherein when the second cutting operation ends and the first cutting operation starts, the cut piece collecting portion cover is in the closed state, and when the first cutting operation ends and the second cutting operation starts, the cut piece collecting portion cover is in the open state.

11. The printer according to claim 1, further comprising a support member to support the cutter unit, wherein the cutter unit is provided on one side of the support member and a movable cutter drive gear is provided on the other side of the support member, a movable cutter drive gear pin provided on a surface of the movable cutter drive gear facing the support member is inserted into a long hole provided at the movable cutter, an inner circumferential gear whose rotation center is the same as the rotation center of the movable cutter drive gear is provided on the surface of the movable cutter drive gear on the side opposite to the support member, a lever member drive gear engaging with the inner circumferential gear is provided, and a lever member drive gear pin is provided on the surface of the lever member drive gear on the side opposite to the support member and the lever member drive gear pin can contact the lever member.

12. The printer according to claim 11, wherein a portion of the lever member that comes into contact with the lever member drive gear pin of the lever member drive gear has a cam shape.

13. The printer according to claim 11, wherein the cut piece collecting portion cover is mounted on the cut piece collecting portion via a rotation support member positioned at one edge thereof, an arm portion protruding outward via a side face of the cut piece collecting portion is provided in the rotation support member of the cut piece collecting portion, the arm portion is provided with a hook and a pin, a spring acting like a tensile force is locked to the hook of the arm portion and a hook provided on the external side face of the cut piece collecting portion, and the pin of the arm portion is inserted into a long hole provided in the lever member.

14. The printer according to claim 1, wherein when the cutting operation of the cut piece by the cutter unit fails and the cutting operation by the cutter unit is performed again, instead of one time, the cutting operation is performed a number of times corresponding to the predetermined number of cutting operations.

15. The printer according to claim 14, further comprising a conveying unit that, when the cutting operation of the cut piece by the cutter unit fails and the cutting operation by the cutter unit is performed again, pulls back the recording paper to a position where the recording paper is not cut even if the cutting operation is performed, and conveys the recording paper to the position where the recording paper is cut by the cutting operation for the last of the predetermined number of cutting operations.

16. The printer according to claim 1 further comprising a detection unit to detect a position of the cut piece collecting portion cover, wherein if the cut piece collecting portion cover is not located at the position in which the cut piece collecting portion cover should be located, the cutting operation is performed by the cutter unit in a state in which the recording paper is not cut.

17. The printer according to claim 1, wherein the movable cutter is provided with an ejection assisting member to eject the printed portion or the cut piece to a side of the cut piece collecting portion cover.

* * * * *